US007450102B2

(12) United States Patent
Lin et al.

(10) Patent No.: US 7,450,102 B2
(45) Date of Patent: Nov. 11, 2008

(54) SOURCE DRIVER AND INTERNAL DATA TRANSMISSION METHOD THEREOF

(75) Inventors: Che-Li Lin, Taipei (TW); Chang-San Chen, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 667 days.

(21) Appl. No.: 11/162,732

(22) Filed: Sep. 21, 2005

(65) Prior Publication Data

US 2007/0013639 A1 Jan. 18, 2007

(30) Foreign Application Priority Data

Jul. 12, 2005 (TW) ..... 94123506 A

(51) Int. Cl.
*G09G 3/36* (2006.01)

(52) U.S. Cl. ..... 345/98; 345/100; 345/204

(58) Field of Classification Search ..... 345/96, 345/98, 100, 204, 87, 209
See application file for complete search history.

(56) References Cited

U.S. PATENT DOCUMENTS

2003/0071778 A1* 4/2003 Lee et al. ..... 345/98
2003/0132907 A1* 7/2003 Lee et al. ..... 345/98
2004/0104872 A1* 6/2004 Kang et al. ..... 345/87
2004/0125067 A1* 7/2004 Kim et al. ..... 345/98

* cited by examiner

*Primary Examiner*—Amare Mengistu
*Assistant Examiner*—Hong Zhou
(74) *Attorney, Agent, or Firm*—Jianq Chyun IP Office

(57) ABSTRACT

A source driver and an internal data transmission method are provided. The present invention employs specially designed switch units and creates specially designed data paths in a source driver, which matches with the driving method for dot invesion and the specially designed pixel array. When the dot inversion driving method is used on a pixel array of a specific design, each output buffer and digital-to-analog converter inside the source driver continuously output voltages of positive polarity and voltages of negative polarity, instead of switching between positive and negative polarities. Consequently, the swing voltages that the source driver outputs can be lowered, the power consumption can also be reduced accordingly, a smaller area is occupied, and the costs are reduced.

8 Claims, 8 Drawing Sheets

| | | | | | |
|---|---|---|---|---|---|
| + | − | + | − | + | − |
| − | + | − | + | − | + |
| + | − | + | − | + | − |
| − | + | − | + | − | + |
| + | − | + | − | + | − |

Frame T

| | | | | | |
|---|---|---|---|---|---|
| − | + | − | + | − | + |
| + | − | + | − | + | − |
| − | + | − | + | − | + |
| + | − | + | − | + | − |
| − | + | − | + | − | + |

Frame T+1

SOURCE DRIVER AND INTERNAL DATA TRANSMISSION METHOD THEREOF

CROSS-REFERENCE TO RELATED APPLICATION

This application claims the priority benefit of Taiwan application serial no. 94123506, filed on Jul. 12, 2005. All disclosure of the Taiwan application is incorporated herein by reference.

BACKGROUND OF THE INVENTION

1. Field of the Invention

The present invention relates to a source driver and an internal data transmission method thereof, and more particularly to a source driver and an internal data transmission method adapted for use with a dot inversion driving method.

2. Description of Related Art

As an important component of a thin film transistor liquid crystal display (TFT-LCD), a source driver is responsible for converting the digital signals required for image displaying into analog signals and outputting the converted signals to every sub-pixel, also referred to as a dot, of a TFT-LCD.

FIG. 1 is a structural block diagram of a conventional source driver 100. Referring to FIG. 1, a conventional source driver 100 receives a plurality of data signals 110 and outputs a plurality of analog signals with N output channels, $Y_1$ through $Y_N$. The conventional source driver 100 includes a shift register 101, a line latch 102, a level shifter 103, a digital-to-analog converter (DAC) 104, and an output buffer 105. Those skilled in the art should understand that in a conventional source driver 100, the shifter register 101 allocates the data signals 110 to output channels $Y_1$ through $Y_N$; then the line latch 102 provisionally stores the data signals 110; and the level shifter 103 amplifies the data signals 110; then the DAC 104 converts the amplified data signals 110 into analog signals; and finally the output buffer 105 outputs the analog signals.

In a TFT-LCD, for avoiding polarization of liquid crystals used as the material for display control, alternating current (AC) voltages accompanying with inversion driving methods such as line inversion, column inversion, and dot inversion must usually be used for driving. FIG. 2 depicts the driving polarity of the sub-pixels of the respective frame T and frame T+1 for a TFT-LCD for illustrating a dot inversion driving method, in which the symbol "+" represents positive driving polarity and symbol "−" represents negative driving polarity. As illustrated in FIG. 2, the so-called dot inversion means that each sub-pixel has opposite polarity with adjacent sub-pixels, irregardless of whether in horizontal or perpendicular direction, and that all the sub-pixels have their polarities inverted at the next frame.

Although a dot inversion driving method has many advantages, it unfortunately consumes relatively more power than others. Referring to FIG. 3, a source driver 301 outputs analog signals to the sub-pixels, SP0 through SP3, of a single scan line SL of a pixel array 303 via an output buffer 302 and data lines DL0 through DL3. Because current large-sized TFT-LCD panel usually adopts a direct current (DC) common voltage (Vcom) design, voltages of positive polarity higher than the common voltage Vcom and voltages of negative polarity lower than the common voltage Vcom are thus possible. For example, the data lines DL0 and DL2 output voltages respectively have polarities as positive, negative, and positive, while the data lines DL1 and DL3 output voltages respectively have polarities as negative, positive, and negative. Whenever upon entering into next scan line or upon a frame is shifted to the next frame, data lines DL0 through DL3 must have their polarities inverted; therefore, the source driver 301 has to provide a swing voltage Vswing which is about twice that of the common voltage Vcom. The higher the Vswing, the more the power consumption becomes. In consistent with increasing panel size, increasing in resolution, and introduction of wider viewing angle technologies such as the in-plane switching (IPS) and multi-domain vertical alignment (MVA), all of which require higher power consumption. Thus the disadvantage of power consumption of the dot inversion driving method becomes even more apparent.

In addition, another disadvantage of the conventional technology is that the DAC has to output voltages of both positive polarity and negative polarity. Being limited by a threshold voltage, an n-channel metal oxide semiconductor field effect transistor (NMOS) is not able to be used for transferring high voltage; whereas, a p-channel metal oxide semiconductor field effect transistor (PMOS) is not able to be used for transferring a low voltage. Therefore, the DAC has to adopt a complementary metal oxide semiconductor field effect transistor (CMOS), which is relatively larger in size and higher in cost.

SUMMARY OF THE INVENTION

An object of the invention is to provide a source driver, adapted for use with a dot inversion driving method, to lower the outputted swing voltages and to reduce power consumption.

Another object of the invention is to provide an internal data transmission method of a source driver for allowing the DAC of the source driver to be able to adopt PMOS and NMOS design. Both of which are smaller in size and cheaper than CMOS.

For achieving the foregoing objects and others, the present invention provides a source driver, including N latches, a first switch unit, N+2 DACs which are respectively categorized into a first type and a second type, a second switch unit, and N+1 output buffers. In the aforementioned, N is a positive integer. The odd numbered DACs are of the first type; and the even numbered DACs are of the second type. The aforementioned output buffers correspond one to one to the N+1 data lines, and are respectively coupled to the corresponding data lines. Given that "i" is an integer and $1 \leqq i \leqq N$, then:

Among the scan lines in which data is to be written, if the odd numbered sub-pixels are of a first driving polarity and the even numbered sub-pixels are of a second driving polarity, and the $i^{th}$ sub-pixels are coupled to the $i^{th}$ data lines, then the first switch unit connects the $i^{th}$ latches and the $i^{th}$ DACs, and the second switch unit connects the $i^{th}$ DACs and the $i^{th}$ output buffers;

Among the foregoing scan lines, if the odd numbered sub-pixels are of the second driving polarity and the even numberd sub-pixels are of the first driving polarity, and the $i^{th}$ sub-pixels are coupled to the $i+1^{th}$ data lines, then the first switch unit connects the $i^{th}$ latches and the $i+1^{th}$ DACs, and the second switch unit connects the $i+1^{th}$ DACs and the $i+1^{th}$ output buffers;

Among the foregoing scan lines, if the odd numbered sub-pixels are of the second driving polarity and the even numbered sub-pixels are of the first driving polarity, and the $i^{th}$ sub-pixels are coupled to the $i^{th}$ data lines, then the first switch unit connects the $i^{th}$ latches and the $i+1^{th}$ DACs, and the second switch unit connects the $i+1^{th}$ DACs and the $i^{th}$ output buffers; and Among the foregoing scan lines, if the odd numbered sub-pixels are of the first driving polarity and the even numbered sub-pixels are of the second driving polarity, and the $i^{th}$ sub-pixels are coupled to the $i+1^{th}$ data lines, then the first switch unit connects the $i^{th}$ latches and the $i+2^{th}$ DACs, and the second switch unit connects the $i+2^{th}$ DACs and the $i+1^{th}$ output buffers.

According to an embodiment of the foregoing source driver, the first type adopts a DAC having an NMOS design and the second type adopts a DAC having a PMOS design, in which the first driving polarity is negative and the second driving polarity is positive.

According to another embodiment of the foregoing source driver, the first type adopts a DAC having a PMOS design and the second type adopts a DAC having an NMOS design, in which the first driving polarity is positive and the second driving polarity is negative.

The present invention further provides another internal data transmission method for the source driver. The method performs substantially the same procedures of the foregoing first and second switch units within the aforementioned source driver, and is not to be repeated herein.

According to the aforementioned embodiment of the present invention, the present invention employs specially designed switch units and creates specially designed data paths in a source driver, and in combination with specially fabricated pixel array for allowing the data signals to be transmitted to the corresponding sub-pixels. When driving with a dot inversion driving method and within the duration of a single frame, a single output buffer is able to continuously output voltages of positive polarity and voltages of negative polarity, instead of switching between positive and negative polarities. Consequently, the swing voltages that are outputted by the source driver are lowered, and the power consumption is also reduced accordingly.

Furthermore, the data paths of the source driver according to the present invention allow half of the DACs to continuously output voltages of positive polarity and the other half of the DACs to continuously output voltages of negative polarity. Therefore, PMOS and NMOS designs are adopted for substituting the conventional CMOS design. As a result, the circuit areas of the DAC circuits are diminished and the corresponding fabrication cost is reduced.

BRIEF DESCRIPTION OF THE DRAWINGS

The features of the invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DESCRIPTION OF THE EMBODIMENTS

Figure 1:
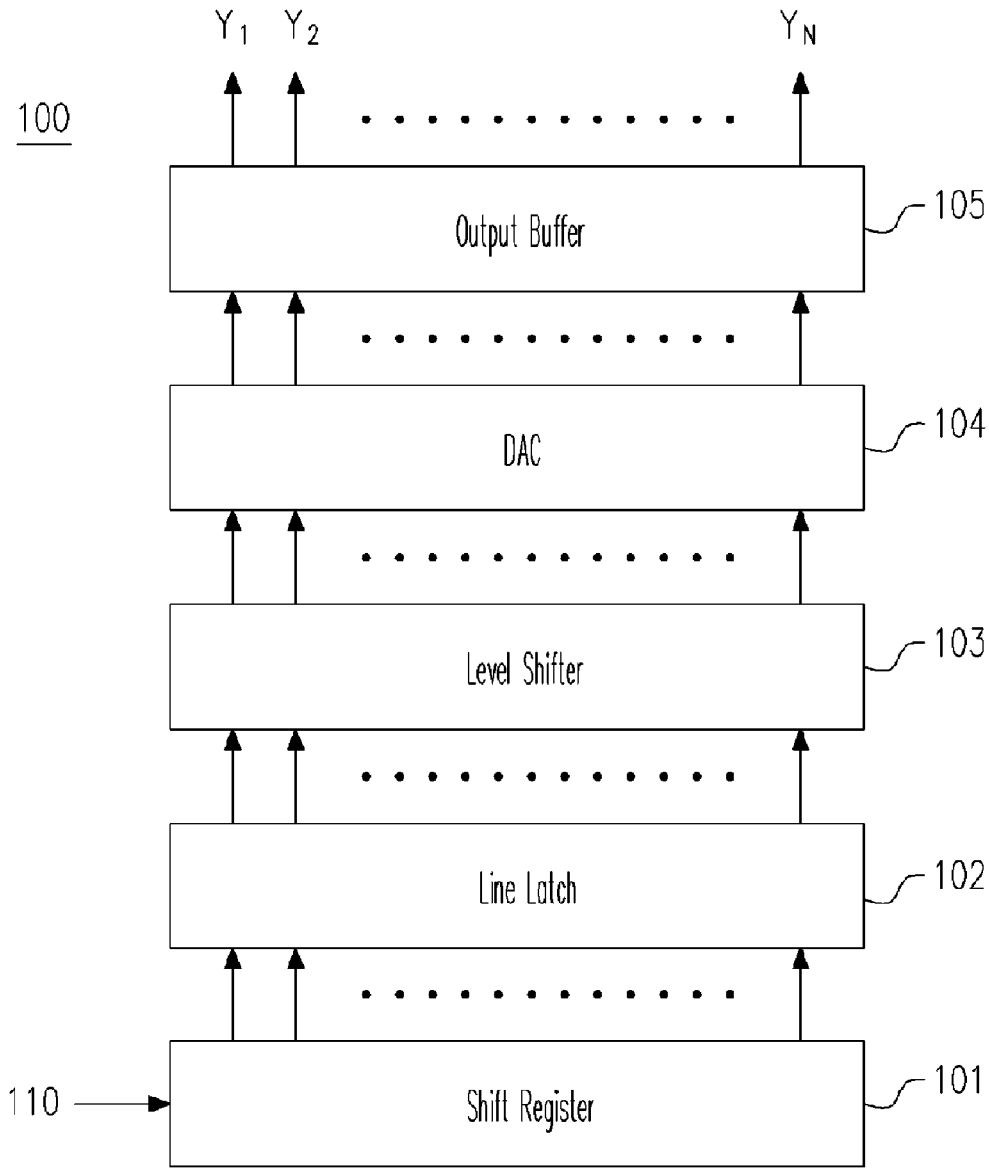
FIG. 1 (PRIOR ART)
FIG. 1 is a structural block diagram of a conventional source driver.
Figures 2, 3:
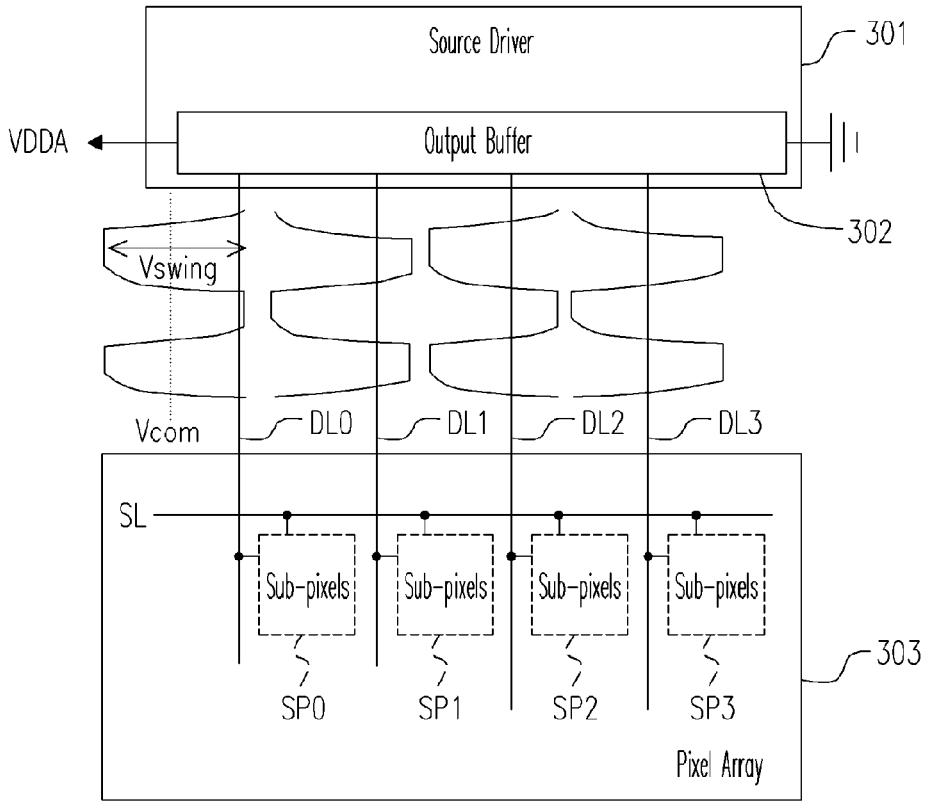
FIG. 3 (PRIOR ART)
FIG. 2 is a schematic diagram illustrating a dot inversion driving method.
FIG. 3 is a schematic signal waveform diagram of a conventional dot inversion driving method.
Figure 4:
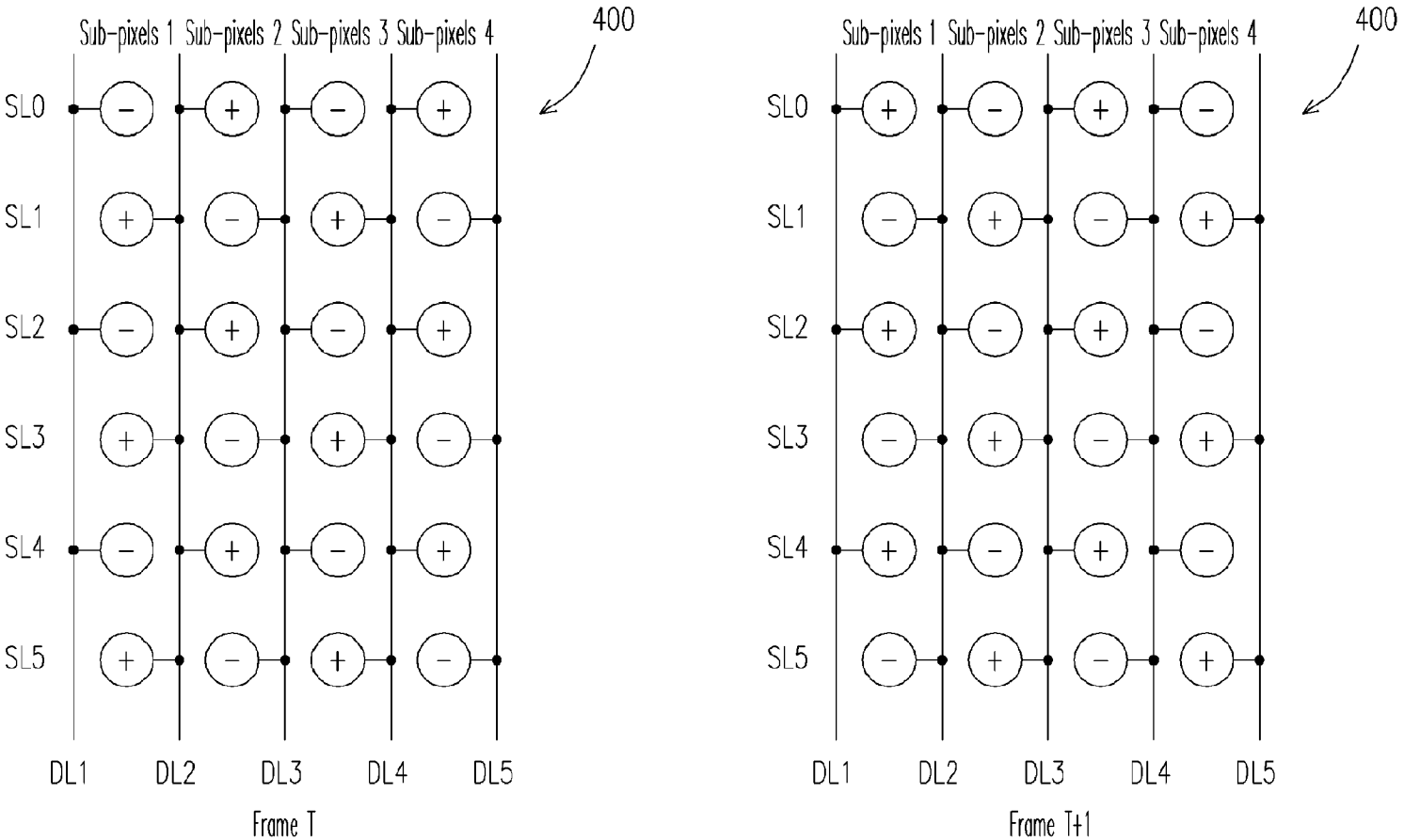
FIG. 4 is a schematic diagram for illustrating a pixel array according to an embodiment of the invention, and the driving polarities of the sub-pixels thereof.

The present invention is adapted for operating in accordance with a specially designed pixel array. Referring to FIG. 4, it illustrates a pixel array 400 according to an embodiment of the invention and the driving polarities of a plurality of sub-pixels when using a dot inversion driving method. The pixel array 400 includes six scan lines, SL0 through SL5, and five data lines, DL1 through DL5. Each scan line has four sub-pixels, which are marked with circles and labeled as 1 through 4, in which the symbol "+" represents positive driving polarity and the symbol "−" represents negative driving polarity. As illustrated in FIG. 4, during a certain frame "T", the driving polarity of a sub-pixel 1 of the scan line SL0 is negative, and during the next frame "T+1", the driving polarity of the sub-pixel 1 of the scan line SL0 is positive.

It should be noted that the pixel array 400 is described herein for illustrative purposes only, and the quantities of either the data lines or the scan lines of the pixel array nor the sub-pixels of each scan line should not be construed as limited as described above. The general rules are, illustrated in FIG. 4, as follows: if there are N sub-pixels, the pixel array includes N+1 data lines; the sub-pixels of a single scan line shall all be coupled to either a data line on the left side or a data line on the right side; sub-pixels of any pair of adjacent up and down scan lines are respectively coupled in opposite directions from left to right.

Figure 5:
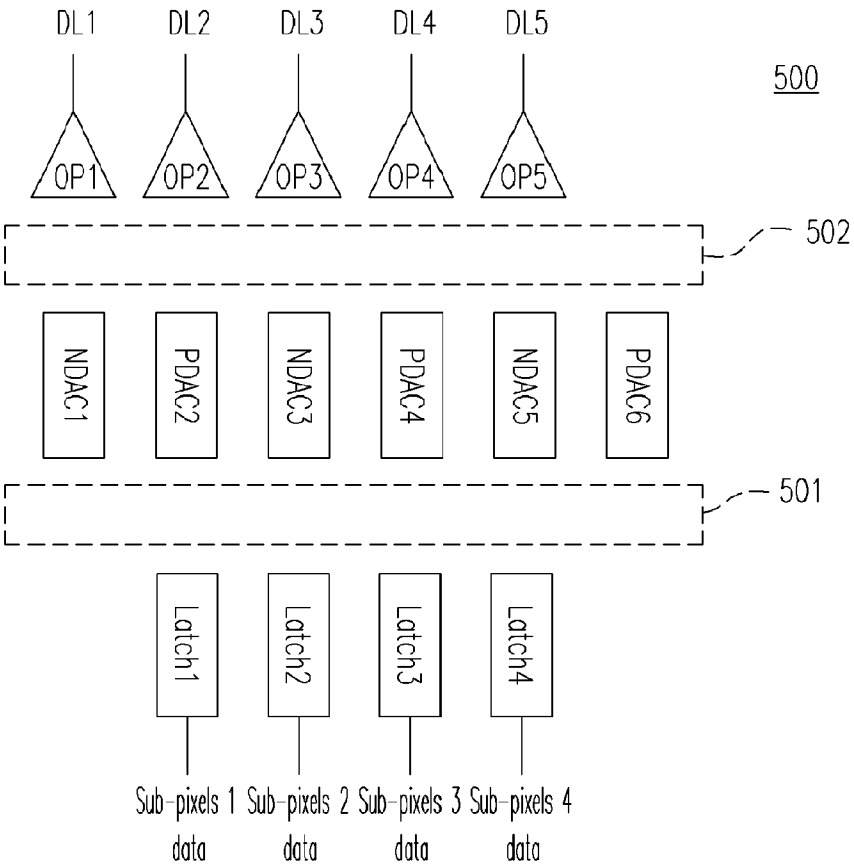
FIG. 5 is a schematic structural diagram of a source driver, according to an embodiment of the invention.

Referring to FIG. 5, it is a schematic structural diagram of a source driver according to an embodiment of the invention. A source driver 500 includes four latches, namely Latch1 through Latch4, a switch unit 501, six DACs, namely NDAC 1 through PDAC 6, a switch unit 502, and five output buffers, namely OP1 through OP5.

The latches Latch1 through Latch4 are adapted for provisionally storing the data of sub-pixels 1 through 4 of a single scan line. The switch unit 501 is responsible for controlling the internal data paths between the latches Latch1 through Latch4 and the DACs NDAC1 through PDAC6. Within the DACs NDAC1 through PDAC6, NDAC1, NDAC3, and NDAC5 adopt NMOS design and are adapted for providing lower voltages of negative polarity to the sub-pixels of negative driving polarity; on the other hand, PDAC2, PDAC4, and PDAC6 adopt PMOS design and are adapted for providing higher voltages of positive polarity to the sub-pixels of positive driving polarity. The switch unit 502 controls the internal data paths between the DACs NDAC1 through PDAC6 and the output buffers OP1 through OP5. The output buffers OP1 through OP5 correspond one to one to the data lines DL1 through DL5, and are coupled respectively to the data lines DL1 through DL5.

Figure 6:
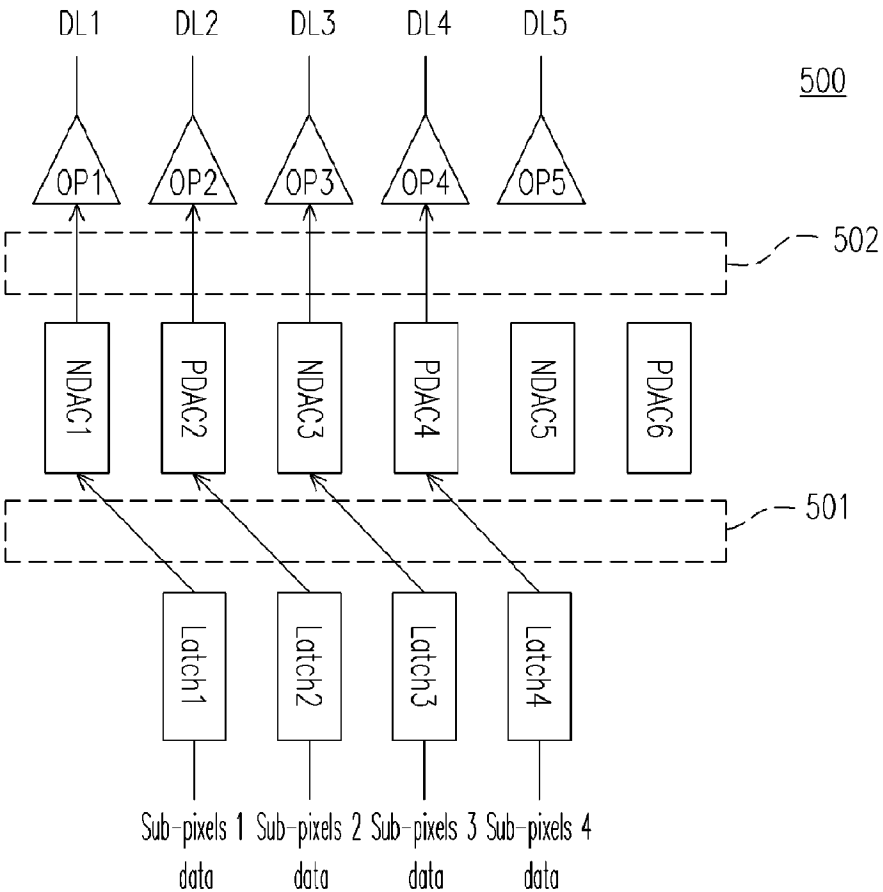
FIGS. 6 through 9 are schematic diagrams illustrating the internal data paths of the source driver of FIG. 5.
Figure 7:
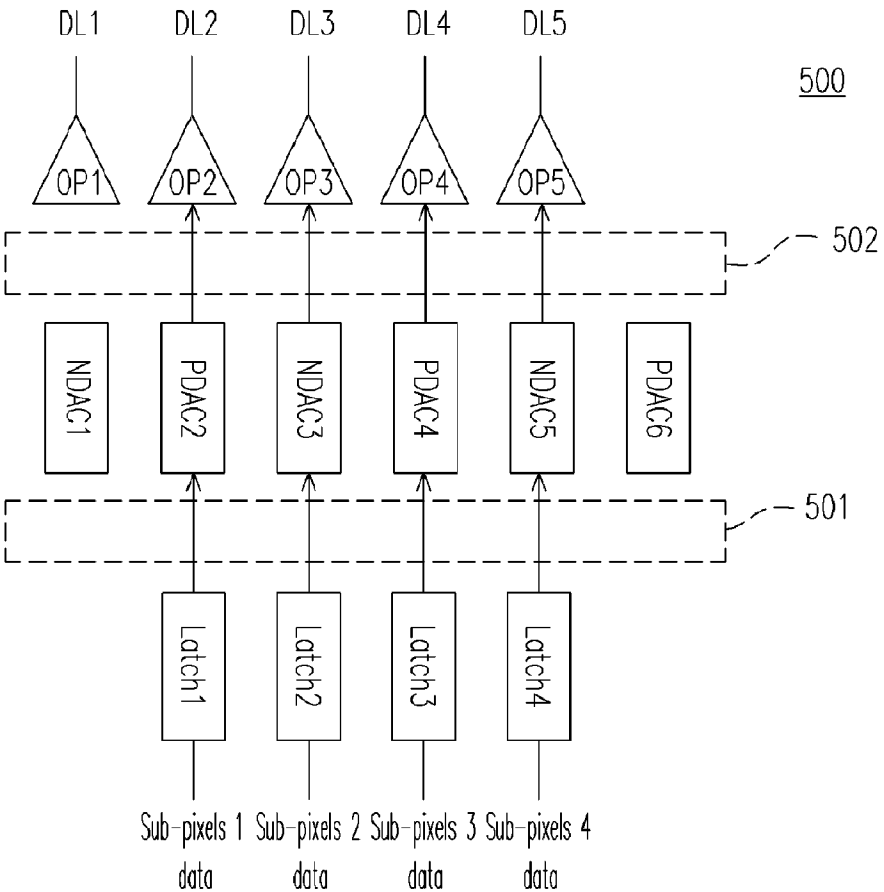
Figure 8:
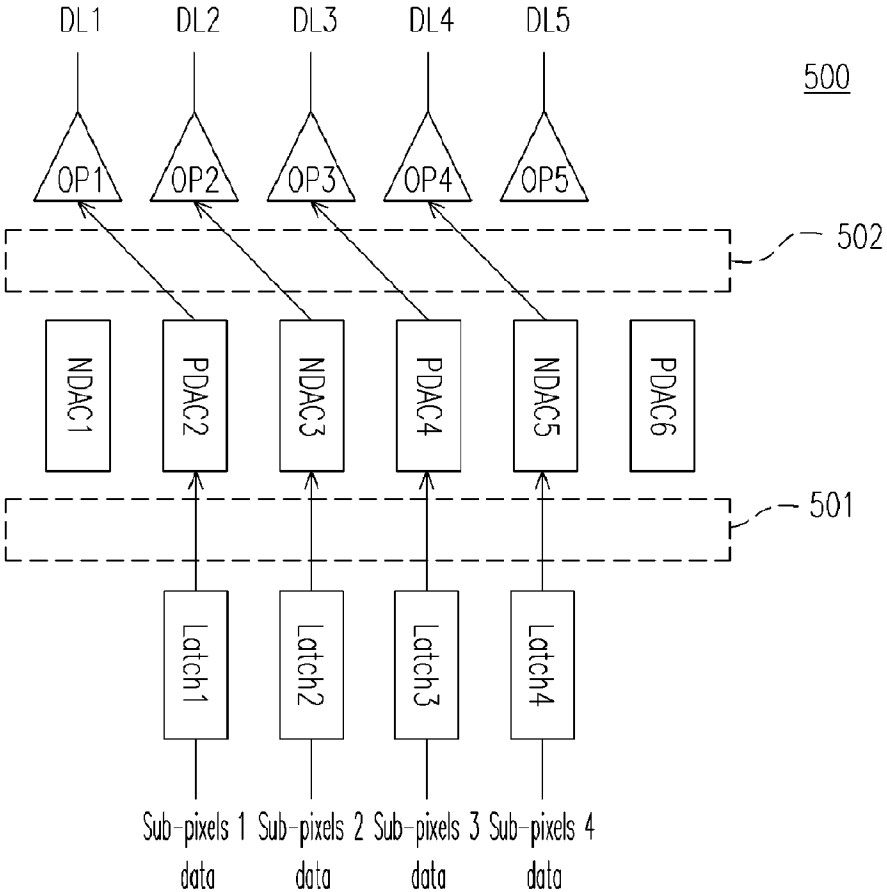
Figure 9:
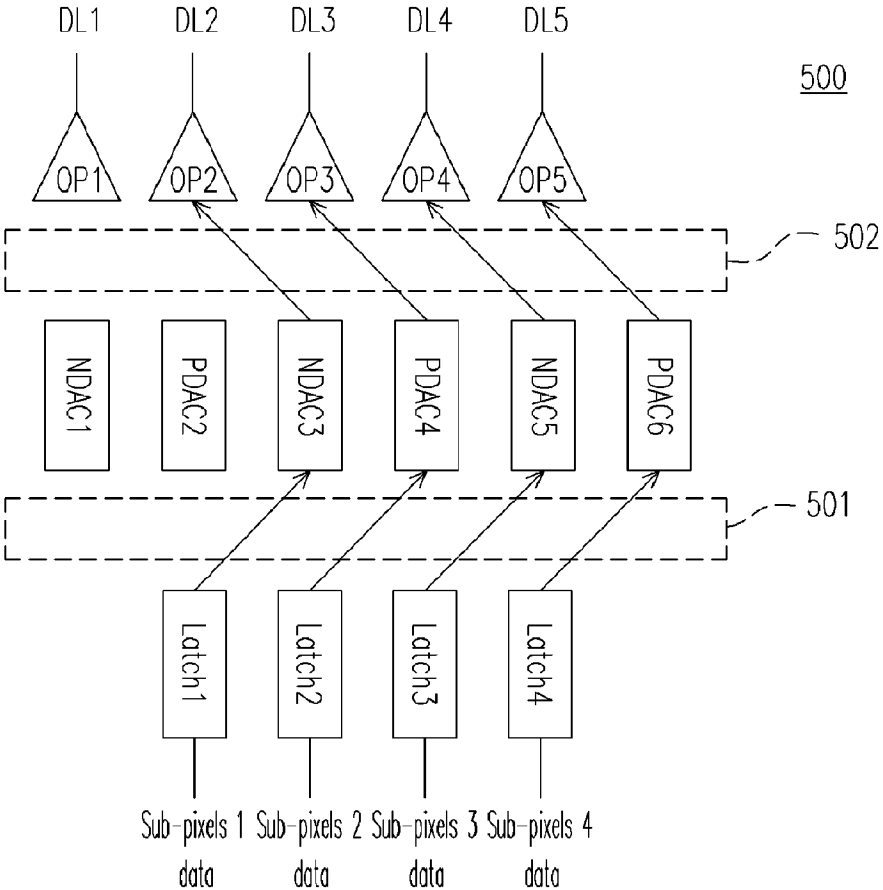

The source driver 500 is adapted for writing data into the sub-pixels of the pixel array 400. The switch units 501 and 502 determine the internal data paths of the source driver 500 according to the driving polarity distribution of each scan line in the pixel array 400, as well as the coupling method between the sub-pixels and the data lines. There are four possible variations of the internal data paths, which are respectively illustrated in FIGS. 6 through 9 as marked by arrow. Hereafter, in the ensuing illustration, given that "i" is an integer and $1 \leqq i \leqq 4$, then:

Among the scan lines in which data is to be written, if the odd numbered sub-pixels, such as sub-pixels 1 and 3, are of negative driving polarity and the even numbered sub-pixels, such as sub-pixels 2 and 4, are of positive driving polarity, and the $i^{th}$ sub-pixels are coupled to the $i^{th}$ data lines, such as the scan lines SL0, SL2, and SL4, during a frame "T", illustrated in FIG. 4, the internal data paths shall put up the first variation as shown in FIG. 6. Meanwhile the switch unit 501 shall connect the $i^{th}$ latches and the $i^{th}$ DACs, and the switch unit 502 shall connect the $i^{th}$ DACs and the $i^{th}$ output buffers;

Similarly, among the scan lines in which data is to be written, if the odd numbered sub-pixels are of positive driving polarity and the even numbered sub-pixels are of negative driving polarity, in which the $i^{th}$ sub-pixels are coupled to the $i+1^{th}$ data lines, such as the scan lines SL1, SL3, and SL5, during the frame "T", as illustrated in FIG. 4, the internal data paths shall put up the second variation as shown in FIG. 7. Meanwhile the switch unit 501 connects the $i^{th}$ latches and the $i+1^{th}$ DACs, and the switch unit 502 connects the $i+1^{th}$ DACs and the $i+1^{th}$ output buffers;

Thereafter, among the scan lines in which data is to be written, if the odd numbered sub-pixels are of positive driving polarity and the even numbered sub-pixels are of negative driving polarity, in which the $i^{th}$ sub-pixels are coupled to the $i^{th}$ data lines, such as the scan lines SL0, SL2, and SL4 during a frame "T+1" illustrated in FIG. 4, then the internal data paths shall put up the third variation as shown in FIG. 8. Meanwhile the switch unit 501 connects the $i^{th}$ latches and the $i+1^{th}$ DACs, and the switch unit 502 connects the $i+1^{th}$ DACs and the $i^{th}$ output buffers; and Finally, among the scan lines in which data is to be written, if the odd numbered sub-pixels are of negative driving polarity and the even numbered sub-pixels are of positive driving polarity, in which the $i^{th}$ sub-pixel are coupled to the $i+1^{th}$ data lines, such as the scan lines SL1, SL3, and SL5, during the frame "T+1" illustrated in FIG. 4, the internal data paths shall put up the fourth variation as shown in FIG. 9. Meanwhile the switch unit 501 connects the $i^{th}$ latches and the $i+2^{th}$ DACs, and the switch unit 502 connects the $i+2^{th}$ DACs and the $i+1^{th}$ output buffers.

It can be understood from FIGS. 6 through 9, during a scan period of a frame "T", the odd numbered output buffers OP1, OP3, and OP5 output voltages of negative polarity only, and the even numbered output buffers OP2 and OP4 output voltages of positive polarity only. In contrast, the conventional technology has to switch polarities whenever scan lines are changed. Similarly, during a frame "T+1", the odd numbered OP1, OP3, and OP5 output voltages of positive polarity only, and the even numbered OP2, and OP4 output voltages of negative polarity only. Therefore, the present invention substantially lowers the swing voltages that the source driver outputs during a single frame to half, and thus the power consumption is reduced.

Furthermore, according to FIG. 6 through FIG. 9, no matter during which frame's scan period, the odd numbered DACs NDAC1, NDAC3, and NDAC5 provide only voltages of negative polarity, while the even numbered DACs PDAC2, PDAC4, and PDAC6 provide only voltages of negative polarity. Therefore, PMOS and NMOS designs are able to be adopted for substituting the conventional CMOS design, whereby the areas of the DAC circuits are diminished and the corresponding fabrication cost is reduced.

Those skilled in the art should understand the circuit structures of the switch units 501 and 502 and be able to know how to achieve them. An example is to create a switching network using switch devices such as metal-oxide semiconductor field-effect transistors (MOSFET), such a switching network is enough for controlling the internal data paths of the source driver 500.

It should be understood that the invention is not limited as the above embodiments. A source driver may include N latches, N+2 DACs, and N+1 output buffers, in which N is a positive integer. Herein, the operating rule of the switches 501 and 502 is deduced from the foregoing embodiments as the condition of $1 \leqq i \leqq 4$ is extended to $1 \leqq i \leqq N$. The source driver 500 of FIG. 5 is an example when N=4.

In FIG. 5, all odd numbered DACs are NDACs, and all even numbered DACs are PDACs. However, the circumstance may be different in other embodiments according to the present invention, in which all odd numbered DACs are PDACs, and all even numbered DACs are NDACs. Whatever the data paths are to be selected, it is a must to have the positive polarity driving and the negative polarity driving in opposite manner for allowing the source driver to operate properly.

It should be noted that specific embodiments of, and examples for, the invention are described herein for illustrative purposes, various equivalent modifications are possible within the scope of the invention, as those skilled in the relevant art will recognize that modifications and adaptations of the aforementioned preferred embodiments of the present invention may be made to meet particular requirements. This disclosure is intended to exemplify the invention without limiting its scope. All modifications that incorporate the invention disclosed in the preferred embodiment are to be construed as coming within the scope of the appended claims or the range of equivalents to which the claims are entitled.

What is claimed is:

1. A source driver, comprising:

N latches, wherein N is a positive integer;

a first switch unit;

N+2 DACs, wherein the odd numbered DACs are of a first type, and the even numbered DACs are of a second type;

a second switch unit; and

N+1 output buffers, the output buffers correspond one to one to N+1 data lines, and are respectively coupled to the corresponding data lines, wherein given that "i" is an integer and $1 \leqq i \leqq n$, then:

among the scan lines in which data is to be written, if the odd numbered sub-pixels are of a first driving polarity and the even numbered sub-pixels are of a second driving polarity, wherein the $i^{th}$ sub-pixels are coupled to the $i^{th}$ data lines, the first switch unit connects the $i^{th}$ latches and the $i^{th}$ DACs, and the second switch unit connects the $i^{th}$ DACs and the $i^{th}$ output buffers;

among the scan lines, if the odd numbered sub-pixels are of the second driving polarity and the even numbered sub-pixels are of the first driving polarity, wherein the $i^{th}$ sub-pixels are coupled to the $i+1^{th}$ data lines, the first switch unit connects the $i^{th}$ latches and the $i+1^{th}$ DACs, and the second switch unit connects the $i+1^{th}$ DACs and the $i+1^{th}$ output buffers;

among the scan lines, if the odd numbered sub-pixels are of the second driving polarity and the even numbered sub-pixels are of the first driving polarity, wherein the $i^{th}$ sub-pixels are coupled to the $i^{th}$ data lines, the first switch unit connects the $i^{th}$ latches and the $i+1^{th}$ DACs, and the second switch unit connects the $i+1^{th}$ DACs and the $i^{th}$ output buffers; and among the scan lines, if the odd numbered sub-pixels are of the first driving polarity and the even numbered sub-pixels are of the second driving polarity, wherein the $i^{th}$ sub-pixels are coupled to the $i+1^{th}$ data lines, the first switch unit connects the $i^{th}$ latches and the $i+2^{th}$ DACs, and the second switch unit connects the $i+2^{th}$ DACs and the $i+1^{th}$ output buffers.

2. The source driver according to claim 1, wherein the first type adopts a DAC having an NMOS design and the second type adopts a DAC having a PMOS design, the first driving polarity is negative and the second driving polarity is positive.

3. The source driver according to claim 1, wherein the first type adopts a DAC having a PMOS design and the second type adopts a DAC having an NMOS design, the first driving polarity being positive and the second driving polarity being negative.

4. The source driver according to claim 1, wherein the $i^{th}$ latch is adapted for provisionally storing data of the $i^{th}$ sub-pixels of the scan line.

5. An internal data transmission method of a source driver, being adapted for a source driver, the source driver comprising N latches, N+2 DACs and N+1 output buffers, wherein N is a positive integer, wherein the odd numbered DACs are of a first type, and the even numbered DACs are of a second type, the output buffers correspond one to one to N+1 data lines, and are respectively coupled to the corresponding data lines, given that "i" is an integer and $1 \leqq i \leqq n$, the internal data transmission method comprising the steps of:

among the scan lines in which data is to be written, if the odd numberd sub-pixels are of a first driving polarity and the even numbered sub-pixels are of a second driving polarity, wherein the $i^{th}$ sub-pixels are coupled to the $i^{th}$ data lines, then connecting the $i^{th}$ latches and the $i^{th}$ DACs, and connecting the $i^{th}$ DACs and the $i^{th}$ output buffers;

among the scan lines, if the odd numbered sub-pixels are of the second driving polarity and the even numbered sub-pixels are of the first driving polarity, wherein the $i^{th}$ sub-pixels are coupled to the $i+1^{th}$ data lines, then connecting the $i^{th}$ latches and the $i+1^{th}$ DACs, and connecting the $i+1^{th}$ DACs and the $i+1^{th}$ output buffers;

among the scan lines, if the odd numbered sub-pixels are of the second driving polarity and the even numbered sub-pixels are of the first driving polarity, wherein the $i^{th}$ sub-pixels are coupled to the $i^{th}$ data lines, then connecting the $i^{th}$ latches and the $i+1^{th}$ DACs, and connecting the $i+1^{th}$ DACs and the $i^{th}$ output buffers; and among the scan lines, if the odd numbered sub-pixels are of the first driving polarity and the even numbered sub-pixels are of the second driving polarity, wherein the $i^{th}$ sub-pixels are coupled to the $i+1^{th}$ data lines, then connecting the $i^{th}$ latches and the $i+2^{th}$ DACs, and connecting the $i+2^{th}$ DACs and the $i+1^{th}$ output buffers.

6. The internal data transmission method of a source driver according to claim 5, wherein the first type adopts a DAC having an NMOS design and the second type adopts a DAC having a PMOS design, the first driving polarity is negative and the second driving polarity is positive.

7. The internal data transmission method of a source driver according to claim 5, wherein the first type adopts a DAC having a PMOS design and the second type adopts a DAC having an NMOS design, the first driving polarity is positive and the second driving polarity is negative.

8. The internal data transmission method of a source driver according to claim 5, wherein the $i^{th}$ latch is adapted for provisionally storing data of the $i^{th}$ sub-pixels of the scan line.

* * * * *